US005173964A

United States Patent [19]

Ball et al.

[11] Patent Number: 5,173,964

[45] Date of Patent: Dec. 29, 1992

[54] PIVOTED ADJUSTABLE SHOULDER PAD

[75] Inventors: Roger Ball, Toronto; Steve Copeland, Pickering, both of Canada

[73] Assignee: Sports Licensing, Inc., Hanover, N.H.

[21] Appl. No.: 739,346

[22] Filed: Aug. 1, 1991

[51] Int. Cl.[5] ..... A41D 13/00

[52] U.S. Cl. ..... 2/45; 2/2; 2/267

[58] Field of Search ..... 2/2, 267, 268, 45

[56] References Cited

U.S. PATENT DOCUMENTS

| | | | |
|---|---|---|---|
| 3,740,763 | 6/1973 | Mitchell | 2/2 |
| 3,855,631 | 12/1974 | Ettinger | 2/2 |
| 3,867,726 | 2/1975 | Owl et al. | 2/2 |
| 4,135,252 | 1/1979 | Latina et al. | 2/268 |
| 4,158,242 | 6/1979 | Mitchell | 2/2 |
| 4,320,537 | 3/1982 | Mitchell | 2/2 |
| 4,322,859 | 4/1982 | Mitchell | 2/2 |
| 4,435,851 | 3/1984 | Mitchell et al. | 2/2 |
| 4,467,475 | 8/1984 | Gregory et al. | 2/2 |
| 4,590,622 | 5/1986 | Wolfe et al. | 2/2 |
| 4,680,814 | 7/1987 | Mitchell et al. | 2/45 |
| 4,698,846 | 10/1987 | Wang | 2/2 |
| 4,715,066 | 12/1987 | Mitchell et al. | 2/2 |
| 4,868,925 | 9/1989 | Mitchell | 2/2 |
| 4,989,265 | 2/1991 | Nipper et al. | 2/268 |
| 5,060,313 | 10/1991 | Neuhalfen | 2/2 |

*Primary Examiner*—Werner H. Schroeder
*Assistant Examiner*—Gloria Hale
*Attorney, Agent, or Firm*—Robert K. Tendler

[57] ABSTRACT

A shoulder pad/chest protector combination is provided for use in lacrosse or other sports in which the individual's arm is raised above shoulder level. The shoulder pad is pivoted to the chest protector by a lacing arrangement and is adjustable down the length of the arm by adjustment of the pivot point on the chest protector, with the shoulder pad being made to pivot with the arm by strapping the distal end of the pad to the arm. In one embodiment, the pivotal motion is provided by virtue of the twisting of the laces between the chest protector portion and the overlying shoulder pad. In another embodiment the shoulder pad includes a cuff for securing the distal end thereof to the arm of the individual. In one embodiment, lateral adjustment of the pivot point is made possible by providing laterally running lacing apertures at the top of the chest protector over the shoulder, with the lace passing through two apertures in the chest protector and four apertures in the shoulder pad. In one embodiment, the tension on the strands is adjustable by clamping the free ends of the lace. In a further embodiment, the shoulder pad chest protector combination is back closing, in which the back of the chest protector is laced together. This permits the front portion of the chest protector to be provided with a sternum pad to prevent injury. Additionally, mesh and perforated foam is provided for increased ventilation; and in a further embodiment, a neck roll may be added for comfort and protection.

18 Claims, 4 Drawing Sheets

PIVOTED ADJUSTABLE SHOULDER PAD

FIELD OF THE INVENTION

This invention relates to protective apparatus for individuals and more particularly to a shoulder pad arrangement which accommodates both a swinging motion of the arms as well as raising the arm above shoulder level.

BACKGROUND OF THE INVENTION

Shoulder pads have been used in athletics and other occupations in which a chest protector is laced at the front, with shoulder pads extending from the chest protector over the shoulders. However, these shoulder pads are hinged to the outboard portion of the chest protector so that while they are free to move up and down, they cannot pivot at their point of attachment. The result is that as the arm swings, the shoulder moves out from under the pad. While such shoulder pads are suitable for football applications where there is only limited arm movement, in lacrosse the shoulder pad moves away from the top of the shoulder because of the wide ranging arm movement during play. It will be noted that in lacrosse one arm is usually raised above shoulder level when carrying a lacrosse stick. Also in lacrosse, the range of motion of the arms is much greater than in football.

As to lacrosse-type shoulder pads, in general the shoulder pad is also hinged to the chest protector. As a result, when the arms are swung backwardly or forwardly and rotated in their sockets, the shoulder pad is displaced either in front of or in back of the shoulder, leaving it unprotected. Also because of the hinged pad arrangement, there is significant discomfort to the player because the pad gets in the way.

In general, when an arm is moved backwardly of the torso, the hinged shoulder pad moves forward from over the top of the shoulder, whereas when the arm is swung forward the shoulder pad moves back from over top the shoulder. This is because the shoulder pad is not permitted to pivot with arm movement.

Additionally, with prior art-type shoulder pads, when the arm is raised above shoulder level, the shoulder pad along with the chest protector digs into the neck of the player. It is in part because of a lack of lateral adjustability in the positioning of the pad above the shoulder that movement of the arm above shoulder level drives the chest protector and shoulder pad into the neck of the individual.

The above is particularly acute in the game of lacrosse due to the fact that for a large percentage of the time, the arm associated with the head of the lacrosse stick is raised above shoulder level. In fact the entire game is predicated on the ability to raise this arm so as to permit control of the lacrosse stick.

In summary, in lacrosse arm movement forward and aft moves the traditional fixed shoulder pad away from its initial position protecting the top of the shoulder to a position in which the top of the shoulder is left exposed. Since a significant amount of slashing occurs in lacrosse, leaving a shoulder unprotected is dangerous.

There is thus a necessity for providing a combined chest protector and shoulder pad assembly or system in which the shoulder pad is permitted to move with the arm to which it is attached. This provides that the shoulder pad be positioned squarely over the top of the shoulder play. It is also desirable to be able to provide a pad adjustable in a lateral direction up and down the arm so that the shoulder pad assembly is adaptable for use by different size players.

Moreover, present lacrosse protective garments are front closing, with laces up the front. For large players, this results in a gap over the sternum. Since a significant number of sternum injuries occur each year, additional sternum protection is necessary.

In summary, in the game of lacrosse, slashing with the lacrosse stick is a primary concern both at the top of the shoulder and at the bicep, whereas leaving the sternum unprotected in a front lace configuration subjects the player to injury through the gap in the front of the chest protector.

SUMMARY OF THE INVENTION

In order to accommodate the game of lacrosse, the subject protective garment includes a shoulder pad, chest protector combination configured in such a way that the shoulder pad is pivotally attached to the top of the chest protector at its outboard edge so that, with the distal end of the shoulder pad anchored to the arm, the shoulder pad rotates with the arm to maintain its position directly above the shoulder. Additionally, the pivot point is adjustable laterally, up and down the arm, so that when the arm is raised, the edge of the chest protector and the edge of the shoulder pad do not dig into the individual's neck when the arm is raised above the shoulder level.

Additionally, while in the past the shoulder pads were allowed to move independently of the arms and vice versa, in the subject invention the outboard end of the shoulder pad is secured to the bicep or another portion of the arm so that pad pivoting is governed by the movement of the underlying arm.

Because of the pivoting of the pad as well as its adjustability up and down the arm, the shoulder pad/chest protector combination is adapted to fit a wide range of body types and sizes.

Moreover, a back closing structure is provided which eliminates the problems of players having big shoulders that ordinarily increases the opening between the two halves of the chest protector. Since this is a critical area for protection, the chest protector is made both with back lacing and is provided with a sternum pad in front between the two halves of the chest protector.

The entire combination provides more protection for the shoulder and bicep where slashing occurs, whereas the flexible pivoting of the shoulder pad on the chest protector makes the shoulder pad move with the arm so that it stays in place while at the same time providing increased flexibility. Adjustable tension in lacing the shoulder pad to the chest protector also provides for increasingly flexible adjustment.

In a still further embodiment, a neck roll is provided for additional protection between the shoulder pad and the neck to provide increased protection.

Finally, increased ventilation is afforded through the utilization of a mesh fabric cover and the utilization of perforated foam.

In summary, a shoulder pad/chest protector combination is provided for use in lacrosse or other sports in which the individual's arm is raised above shoulder level. The shoulder pad is pivoted to the chest protector by a lacing arrangement and is adjustable down the length of the arm by adjustment of the pivot point on the chest protector, with the shoulder pad being made to pivot with the arm by strapping the distal end of the pad to the arm. In one embodiment, the pivotal motion is provided by virtue of the twisting of the laces between the chest protector portion and the overlying shoulder pad. In another embodiment the shoulder pad includes a cuff for securing the distal end thereof to the arm of the individual. In one embodiment, lateral adjustment of the pivot point is made possible by providing laterally running lacing apertures at the top of the chest protector over the shoulder, with the lace passing through two apertures in the chest protector and four apertures in the shoulder pad. In one embodiment, the tension on the strands is adjustable by clamping the free ends of the lace. In a further embodiment, the should pad chest protector combination is back closing, in which the back of the chest protector is laced together. This permits the front portion of the chest protector to be provided with a sternum pad to prevent injury. Additionally, mesh and perforated foam is provided for increased ventilation; and in a further embodiment, a neck roll may be added for comfort and protection.

BRIEF DESCRIPTION OF THE DRAWINGS

These and other features of the subject invention will be better understood taken in conjunction with the Detailed Description in conjunction with the Drawings of which

DETAILED DESCRIPTION

Figure 1A:
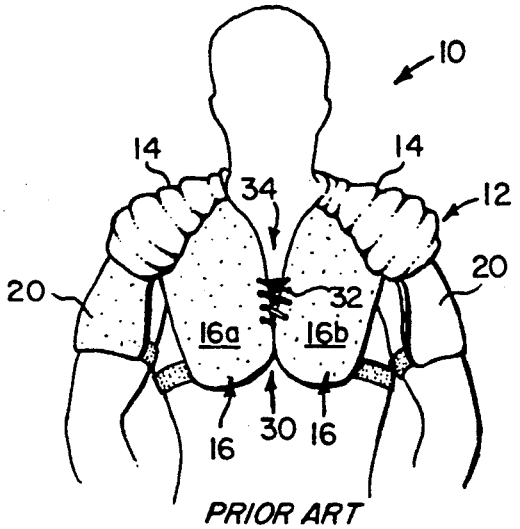
PRIOR ART Fig. 1A
FIG. 1A is a diagrammatic representation of a prior art shoulder pad/chest protector combination.

Referring now to FIG. 1A, in the prior art an individual 10 is provided with a protective garment 12 in the form of a shoulder pad 14/chest protector 16 combination. As illustrated in FIG. 1B, shoulder pad 14 is hinged to chest protector 16 via a sewn flap 18. A bicep protector 20 is also hinged to chest protector 16 as illustrated at 22 so that while the shoulder pad is free to move, it can only move about an axis illustrated by dashed line 24, whereas bicep protector 20 can only move about an axis defined by dashed line 26.

Figure 1C:
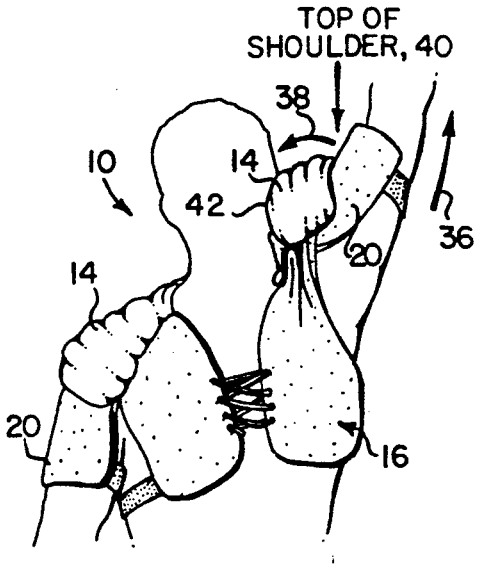
PRIOR ART Fig. 1C
FIG. 1C is a diagrammatic illustration of the protective garment of FIG. 1A showing the interference of the shoulder pad with the neck of the individual during the raising of the individual's arm.
Figure 1B:
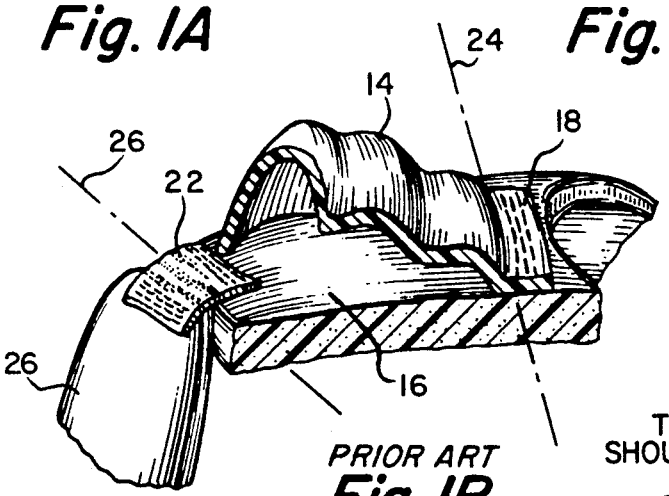
PRIOR ART Fig. 1B
FIG. 1B is a cross sectional and diagrammatic illustration of the attachment of the shoulder pad to the chest protector for the garment of FIG. 1A, illustrating a hinged attachment.
Figure 1D:
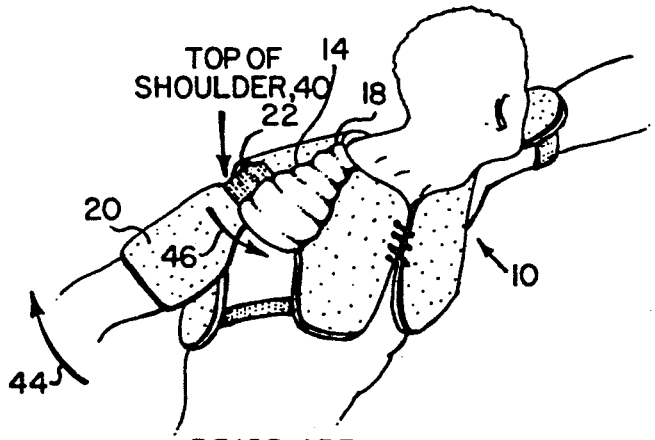
PRIOR ART Fig. 1D
FIG. 1D is a diagrammatic illustration of the garment of FIG. 1A, illustrating the movement of the shoulder pad in front of the top of the shoulder with a back movement of the associated arm.
Figure 1E:
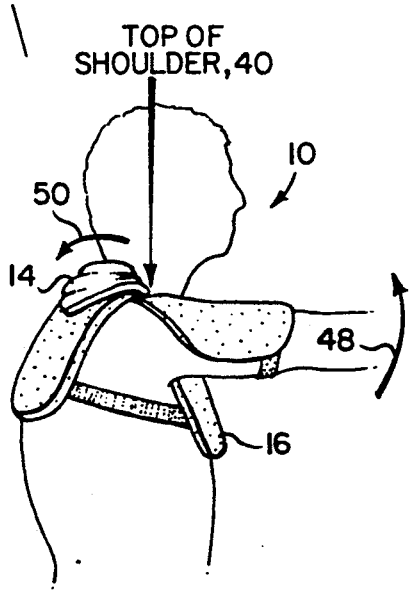
PRIOR ART Fig. 1E
FIG. 1E is a diagrammatic illustration of the backward movement of the shoulder pad from the top of the shoulder of an individual with a forward motion of the arm.

As will be appreciated, as a result of the hinge-like attachment method employed in prior art shoulder pads, there is no pivotal motion either of the shoulder pad or the bicep protector and that, as will be seen in FIGS. 1C–1E, when the individual's arms are either swung or raised, shoulder pad 14 moves out from over top of the shoulder which exposes the shoulder to injury.

Referring again to FIG. 1A, it will also be appreciated that the chest protector portion of the protective garment is provided with two halves **16*a* and 16*b* which are joined centrally at 30 by a lacing arrangement generally indicated by reference character 32. As mentioned hereinbefore, this front lacing arrangement provides an open area, here illustrated at 34** in the vicinity of the sternum which leaves the sternum unprotected.

Referring now to FIG. 1C, when the individual's arm is moved as illustrated by arrow 36, the entire bicep protector 20, shoulder pad 14, and chest protector 16 combination moves in the direction of arrow 38 so that shoulder pad 14 not only moves out from over the top of the shoulder as indicated by arrow 40, its edge 42 digs into the neck of the player.

This prior art shoulder pad/chest protector combination, as illustrated in FIG. 1D is also responsible for the dislodging of shoulder pad 14 from the top of the shoulder with a backward movement of the arm as illustrated by arrow 44, such that the shoulder pad moves in the direction of arrow 46 in front of the top of the shoulder as illustrated by arrow 40.

Likewise, and referring now to FIG. 1E, when the individual's arm is raised as illustrated by arrow 48, shoulder pad 14 moves in the direction of arrow 50, backwardly and again off of the top of the shoulder as illustrated by arrow 40.

What can be seen is that with the prior art shoulder pad, the lacrosse player is relatively unprotected at the top of the shoulder which is susceptible to a slashing move that can cause shoulder separation.

Figure 2A:
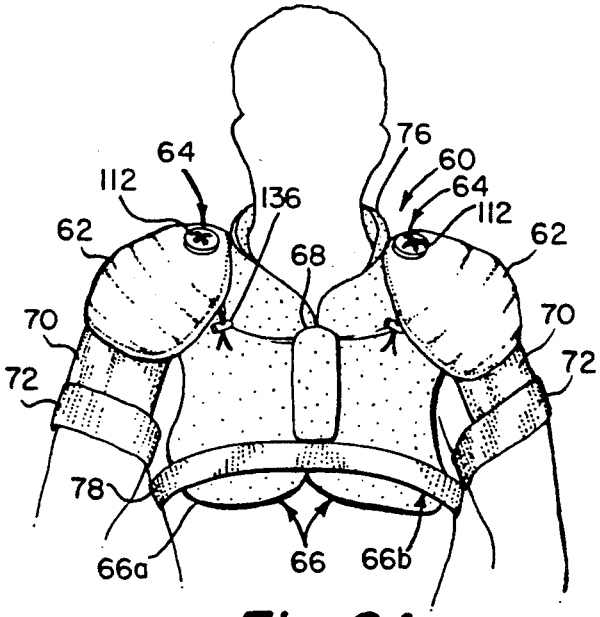
FIG. 2A is a diagrammatic and front view of the subject shoulder pad/chest protector garment, illustrating the shoulder pads pivoted to the chest protector, and also illustrating the utilization of a sternum pad in the middle of the chest protector, with the outboards ends of the shoulder pad being bound to and secured to the respective arm of the individual.

Referring now to FIG. 2A, the subject protective garment, here illustrated by reference character 60 is shown to include shoulder pads 62 pivotally mounted at 64 via a lacing system to be described to a chest protector generally indicated by reference character 66 which includes a sternum pad 68 in between chest protector halves 66*a* and 66*b*.

A bicep pad or protector 70 is attached to its respective shoulder pad, with the bicep protector pad having a bicep engaging strap 72 which secures the outbound edge of the bicep protector pad to the player's arm.

Additionally, the top portion of the chest protector which surrounds the neck is provided with a neck roll 76 as illustrated, with the bottom portion of the chest protector provided with a circumferentially extending strap 78.

Figure 4:
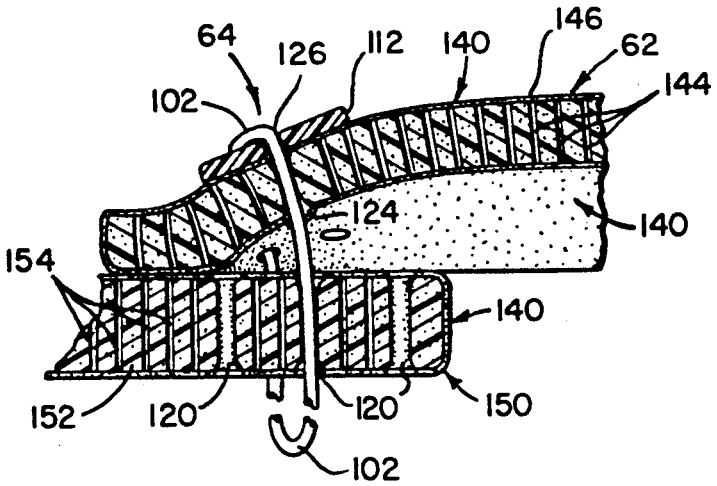
FIG. 4 is a cross sectional and diagrammatic illustration of a portion of the lacing system of the shoulder pad/chest protector of FIG. 3, illustrating both the lacing construction and the utilization of a porous rubber sponge-like material having open weave mesh to either side thereof for ventilation purposes.

As illustrated, the chest protector is provided with a mesh-like material 79 for ventilation which, as will be seen in connection with FIG. 4 hereafter is utilized to sandwich a perforated or cellular sponge-like or rubber-like material therebetween, with the sandwich combination acting both for padding and for ventilation purposes.

Figure 2B:
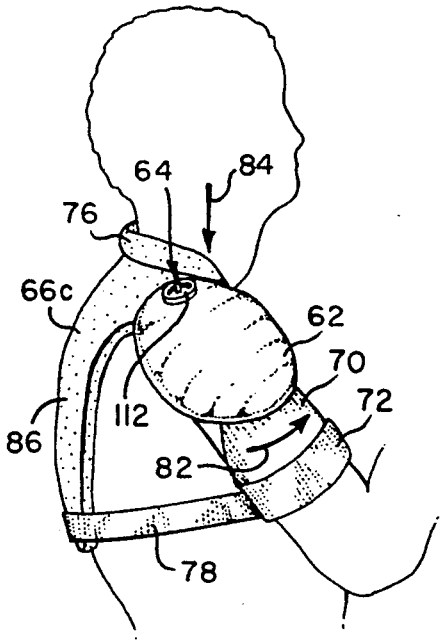
FIG. 2B is a diagrammatic illustration and side view of the subject shoulder pad/chest protector garment illustrating the movement of the shoulder pad over the top of the shoulder when the arm of the individual moves upwardly.

Referring to FIG. 2B, it can be seen that with the movement of the player's arm as illustrated by arrow 80, shoulder pad 62 rotates as illustrated by arrow 82 to be positioned directly over the top of the shoulder here illustrated by arrow 84, the pad having pivoted about a point 64 due to the attachment of the bicep protector to the arm. Here, one half of the back of the chest protector is illustrated at 66*c* to be laced at 86 to a mating back half.

Figure 2C:
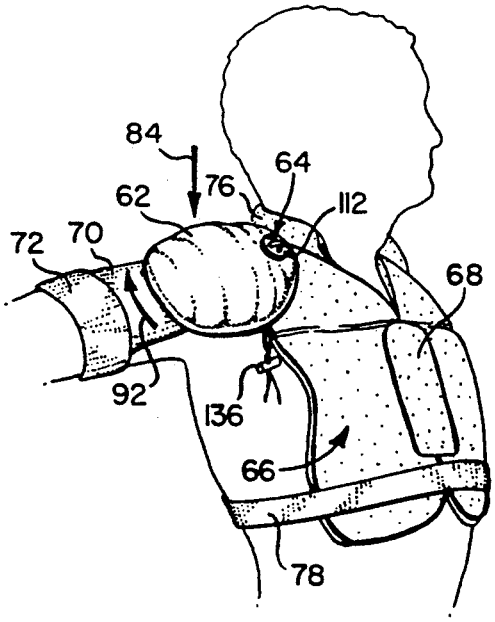
FIG. 2C is a diagrammatic illustration and side view of the subject shoulder pad/chest protector garment, illustrating the movement of the pivoted shoulder pad with a backward movement of the arm.
Figure 2D:
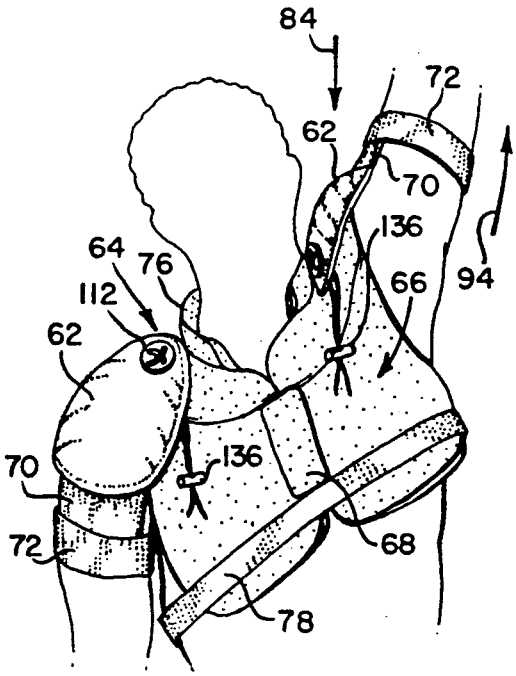
FIG. 2D is a diagrammatic illustration and front view of the subject shoulder pad/chest protector garment illustrating the maintenance of the shoulder pad above the shoulder with an upward movement of the arm.

Referring to FIG. 2C with a backward movement of the arm of the player as illustrated at arrow 90, the bicep-shoulder pad combination rotates as illustrated by arrow 92 such that shoulder pad 62 again is directly above the shoulder as indicated by arrow 84. Likewise in FIG. 2D with an upward movement of the arm as illustrated by arrow 94, shoulder pad 62 is again directly above the top of the shoulder as indicated by arrow 84. It will be appreciated from this drawing, the neck of the individual is protected by the neck roll 76.

What can be seen from the above is that the top of the shoulder is uniquely protected by the subject pivotal arrangement of the shoulder pad with the chest protector. Note also that the player's sternum is appropriately protected by pad 68, with the neck roll providing an even further measure of protection and security.

Figure 3:
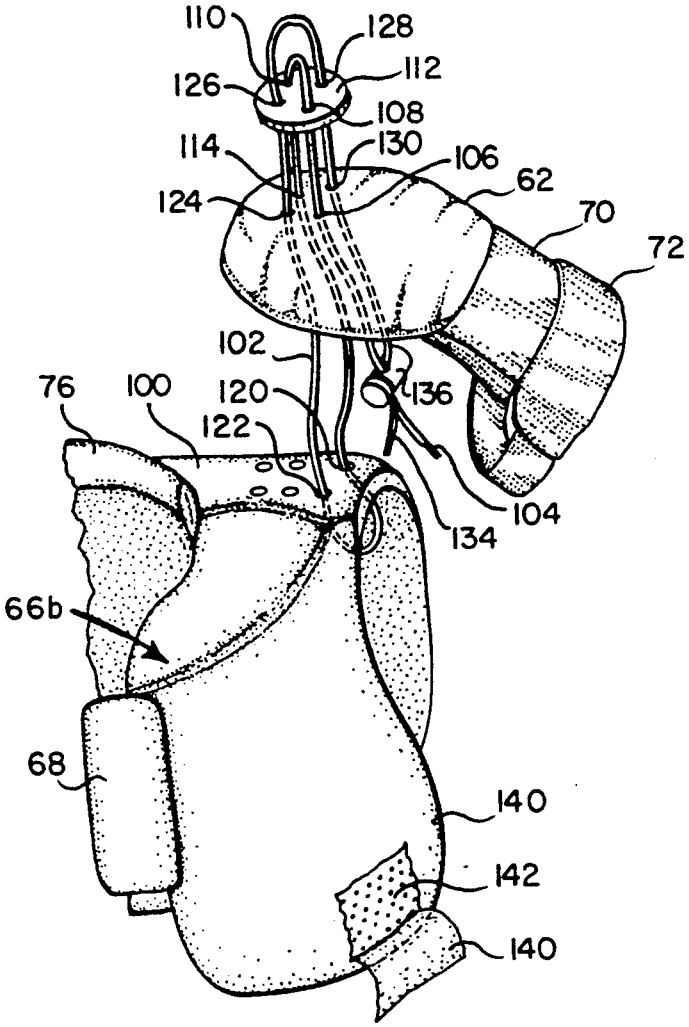
FIG. 3 is an exploded view of a portion of the chest protector and the lacing system of the shoulder pad to the chest protector, illustrating lateral adjustability as well as appropriate lace tensioning apparatus.

Referring now to FIG. 3, shoulder pad 62, bicep protector 64 combination is laced to the top portion 100 of chest protector 66*b* by a lace 102 starting from an end 104 projecting through a hole 106 in pad 62 and going up through holes 108 and 110 in an anchoring disk 112 from whence it goes down through a hole 114 in pad 62. From there it passes through one of the laterally-running holes 120 on the top of the chest protector and then back through another hole 122 in a line of holes arranged parallel with holes 120. From there the lace goes up through a hole 124 in shoulder pad 62 and then through holes 126 and 128 in disk 112. From there the lace goes through a hole 130 in pad 62 and thence down to terminate at an end 134 as illustrated. A lace clamping device 136 is utilized to clamp the free ends of the lace so that the pivotal flexibility is fully adjustable by tension on the lace.

As illustrated, the lines of holes 120 and 122 run laterally across the top of the shoulder so that the pivotal point of attachment of the shoulder pad to the chest protector is adjustable up and down the arm of the individual. This permits locating the shoulder pad directly above the shoulder regardless of the player's size or physique.

As can be seen in this figure, mesh material here illustrated at 140 covers a porous cellular material here exposed at 142, with the mesh and porous material providing breathability for the protective garment.

Referring to FIG. 4 this sandwich structure is more clearly illustrated in which the cellular material 142 is shown to have passages 144 running from an exterior surface 146 to an interior surface 148 with the mesh material 140 to either side of this material in a sandwich relationship.

As can be seen, shoulder pad 62 is laced to an underlying portion 150 of chest protector 66*b* which is made of a similar type of porous material, here illustrated at 152 as having slots 154 therethrough for ventilation purposes. It will be appreciated that holes 120 or 122 are shown to be larger than the channels through this sponge-like rubbery material. This portion of the garment is also made to be surrounded by an open weave web-like material 140 such that the whole structure as illustrated is made to breath.

Figure 5:
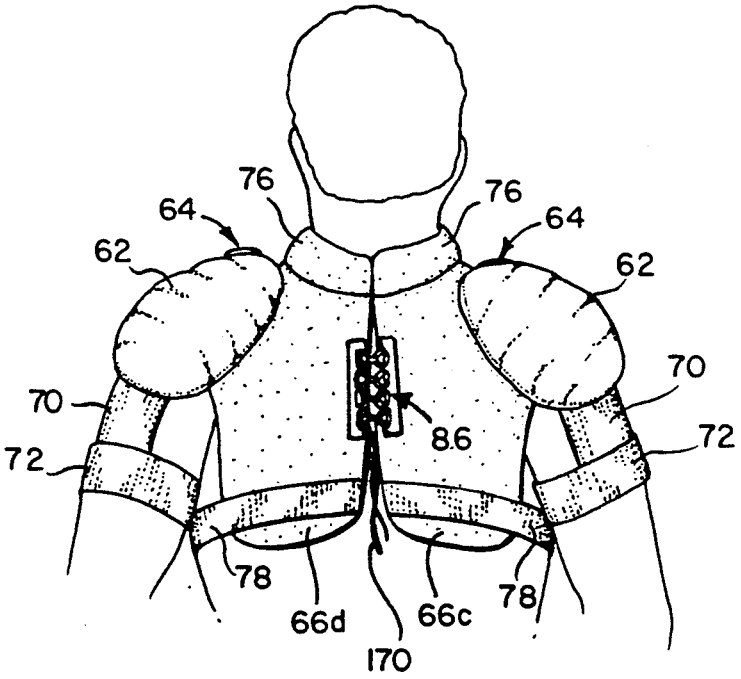
FIG. 5 is a diagrammatic illustration of the back closure of the subject shoulder pad/chest protector garment.

Referring now to FIG. 5, the back closing and lace structure is shown at 86 to include a lace 170 joining the back portions 66*c* and 66*d* of the chest protector. The back closing permits the fixed structure in the front of the garment so that the sternum pad can be carried and positioned at the proper place.

While the subject protective garment has been described for use in lacrosse, it may be used as a protective garment for any sport or for any activity requiring shoulder protection.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. A protective garment for use by individuals engaged in athletic activities comprising in combination, a chest protector including padding extending, when worn, over the shoulders at an outlying portion thereof and down the front of the individual, said chest protector padding being joined along a vertical centerline;

a pair of shoulder pads; and means for pivotally mounting each shoulder pad over respective outlying portions of said chest protector such that each shoulder pad is positioned over its respective shoulder and is free to pivot thereat in a lateral direction with forward and back arm movement.

2. The protective garment of claim 1 and further including means for securing a distal portion of each shoulder pad to the arm of the individual.

3. The garment of claim 2 wherein each of said shoulder pads has a distal end and further including bicep protecting padding attached to the distal end of a shoulder pad.

4. The garment of claim 1 and further including a sternum protecting pad fixed to said chest protector and straddling said vertical centerline in a position to protect the individual's sternum.

5. The garment of claim 4 wherein said chest protector is back closing and includes spaced apart back pad portions and means intermediate said back pad portions for lacing said back pad portions together.

6. The garment of claim 1 wherein said chest protector and said shoulder pads include resilient perforated material, with the perforations running from an outer surface to an inner surface thereof; and, further including an open weave mesh material surrounding said resilient perorated material, thereby to provide increased ventilation.

7. The garment of claim 1 wherein said chest protector has a neck retaining aperture therethrough at the top thereof, and further including a neck roll secured to said chest protector at the said neck retaining aperture.

8. The garment of claim 1 wherein said shoulder pads are pivoted at a pivot point and wherein said means for adjusting the pivot point of a shoulder pad across the shoulder and down the arm of said individual for permitting positioning of a shoulder pad immediately atop an underlying shoulder.

9. The garment of claim 8 wherein said means for pivotally securing a shoulder pad includes a lace through adjoining portions of a shoulder pad and the underlying chest protector.

10. The garment of claim 9 wherein said chest protector has a top, and wherein the portion of said chest protector over a shoulder includes apertures running in the direction of the arm and extending outwardly along the top of the chest protector; and, wherein said lace is passed through one of said apertures for adjusting the pivot point of the overlying pad to accommodate different size individuals.

11. The garment of claim 1 wherein said means for pivotally mounting a shoulder pad includes a lace through said pad and the underlying portion of said chest protector.

12. The garment of claim 11 wherein said means for pivotally mounting a shoulder pad includes a button on top of a shoulder pad, said button having apertures therethrough, said lace passing through said button-carried apertures.

13. The garment of claim 11 and further including means for clamping together the ends of said lace for permitting adjustment of the tension of said lace and thus the flexibility o said pivotal mounting means.

14. A method for constructing a protective garment in a manner assuring the positioning of shoulder pads immediately over the shoulders of an individual, comprising the steps of providing the individual with a chest protector having a head accommodating aperture such that the chest protector can be slipped over the individual's head with the chest protector extending outwardly over the individual's shoulders;

pivotally mounting shoulder pads to the chest protector at laterally spaced top portions thereof such that the shoulder pads pivot in a lateral direction with arm movement; and, securing a distal end of a shoulder pad to the underlying arm of the individual.

15. A method for protecting the sternum of individuals of varying physique, comprising the steps of providing the individual with a chest protector having an aperture for he head and padding extending down the front of the individual across the individual's chest; and, fixedly attaching a vertically-running sternum pad to the chest protector so that it will lie over the individual's sternum when the chest protector is in place.

16. The method of claim 14 and further providing back closing for the chest protector.

17. A method of providing shoulder protection to individuals of varying physique, comprising the steps of:

providing the individual with a chest protector, a portion of which overlies the individual's shoulders, and a pair of shoulder pads; and adjustably attaching the shoulder pads to corresponding shoulder overlying portions of the chest protector, with the attachment point being adjustable across the shoulder and down the arm of the individual.

18. The method o claim 16 wherein the attaching step includes pivotally attaching a shoulder pad to the underlying portion of the chest protector.

* * * * *